United States Patent [19]

Love

[11] Patent Number: 4,846,744

[45] Date of Patent: Jul. 11, 1989

[54] ADJUSTABLE FOOTSTRAP FOR SAILBOARD

[75] Inventor: J. Patrick Love, Kailua, Hi.

[73] Assignee: Windsurfing Hawaii, Inc., Goleta, Calif.

[21] Appl. No.: 119,648

[22] Filed: Nov. 12, 1987

[51] Int. Cl.[4] ..... A63C 15/05

[52] U.S. Cl. ..... 441/75; 24/573; 114/39.2; 280/11.3; 411/371; 411/907; 411/910; 441/74

[58] Field of Search ..... 114/39.2; 441/74, 75, 441/79; 280/11.3, 12 H; 411/371, 372, 429, 431, 907, 910; 24/573, 574, 633; 5/434, 443, 444, 82 R; 119/106, 109, 110; 54/1; 128/133, 134, 153; 150/107, 109; 190/115, 903; 297/219, 423, DIG. 4, DIG. 6

[56] References Cited

U.S. PATENT DOCUMENTS

| | | | |
|---|---|---|---|
| 25,295 | 8/1859 | Wheeler | 280/11.3 |
| 730,366 | 6/1903 | Gunthorp | 128/81 R |
| 3,292,748 | 12/1966 | Rifkin | 190/903 |
| 4,243,265 | 1/1981 | Hanik | 128/134 |
| 4,422,455 | 12/1983 | Olsen | 128/134 |
| 4,628,925 | 12/1986 | Witzel | 128/134 |
| 4,649,582 | 3/1987 | Cho | 5/434 |
| 4,693,199 | 9/1987 | Omachen et al. | 441/75 |

FOREIGN PATENT DOCUMENTS

| | | | |
|---|---|---|---|
| 2178297 | 2/1987 | United Kingdom | 441/75 |

OTHER PUBLICATIONS

Da Kine Footstrap in a European Catalog.
New Wave Footstrap in a New Wave Catalog.

*Primary Examiner*—Sherman D. Basinger
*Assistant Examiner*—Thomas J. Brahan
*Attorney, Agent, or Firm*—Donald A. Streck

[57] ABSTRACT

An adjustable footstrap for attachment to the surface of a riding device such as a sailboard, or the like. There is an inner strap member comprising a pair of centrally overlapping straps having provision for attaching outer ends thereof to the surface of the riding device and provision for adjustably fastening inner ends thereof together. There is also an outer padded sheath for covering the inner strap member between the outer ends. The padded sheath comprises a generally rectangular piece of a fabric-covered foam material having provision on facing opposite edges extending between facing opposite ends for releasably fastening the facing opposite edges together. The padded sheath further has provision for releasably fastening the sheath to the inner strap member. The preferred method for adjustably fastening the inner ends of the strap member together comprises a flexible, non-stretching strap carried by one of the centrally overlapping straps and gripping apparatus carried by the other of the centrally overlapping straps for adjustably gripping the flexible, non-stretching strap in infinite increments. The preferred gripping apparatus is a buckle through which the non-stretching strap is threaded through and back upon itself. The preferred method for releasably fastening the facing opposite edges of the outer padded sheath together comprises one-half of a zipper fastened along one of the facing opposite edges and the mating one-half of a zipper fastened along the other of the facing opposite edges.

6 Claims, 6 Drawing Sheets

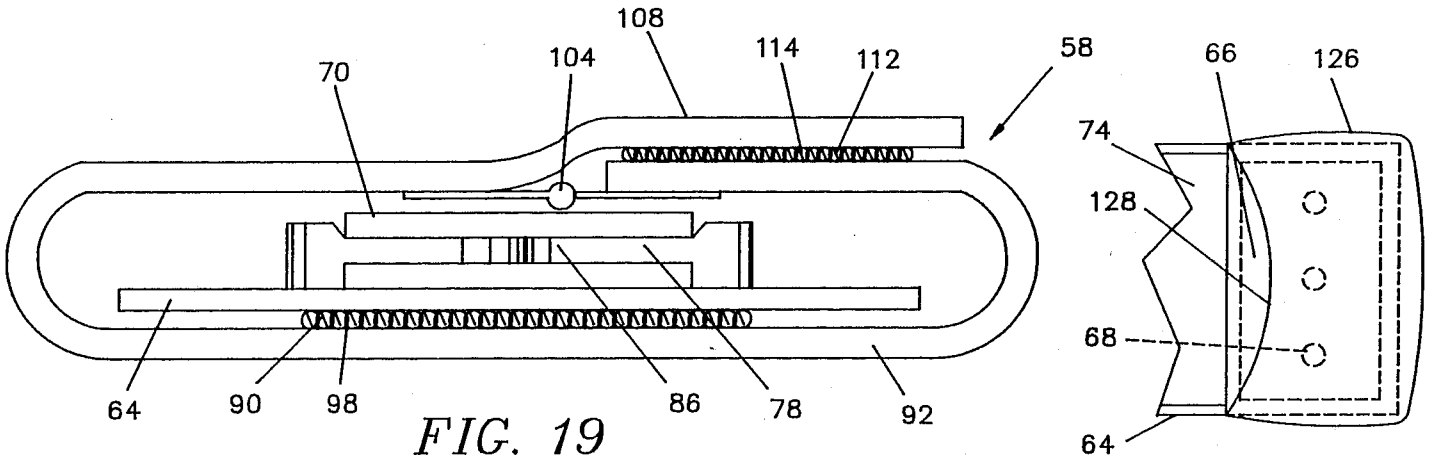
FIG. 19
FIG. 21
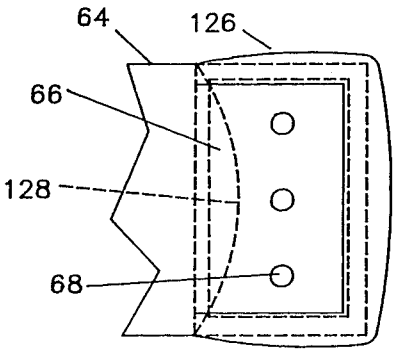
FIG. 22
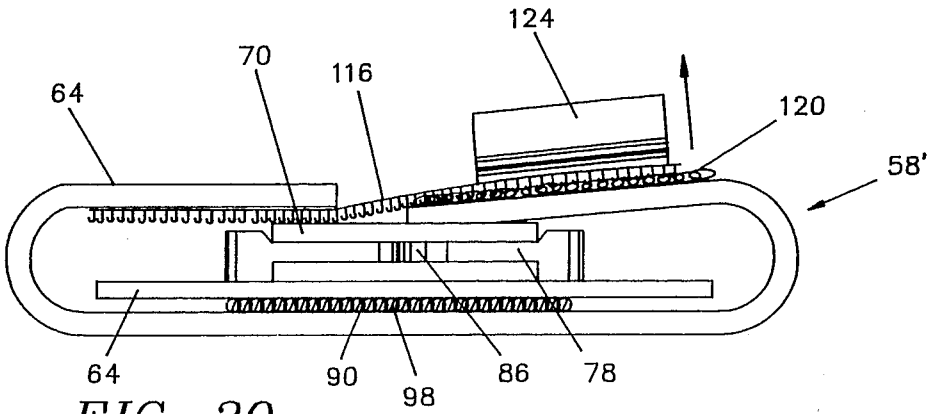
FIG. 20

ADJUSTABLE FOOTSTRAP FOR SAILBOARD

BACKGROUND OF THE INVENTION

The present invention relates to footstraps as employed with devices for riding upon such as sailboard, and the like, and, more particularly, to an adjustable footstrap for attachment to the surface of a riding device comprising, an inner strap member comprising a pair of centrally overlapping straps having means for attaching outer ends thereof to the surface of the riding device and means for adjustably fastening inner ends thereof together; and, an outer padded sheath for covering the inner strap member between the outer ends, the padded sheath comprising a generally rectangular piece of a fabric-covered foam material having means on facing opposite edges extending between facing opposite ends for releasably fastening the facing opposite edges together, the padded sheath further having means for releasably fastening the sheath to the inner strap member.

Sailboards such as those used in the sport of boardsailing or windsurfing are a fairly new innovation (approximately 1977) which have grown rapidly in popularity. As shown in FIGS. 1 and 2, the sailor 10 stands on the board 12 gripping the boom 14 and maneuvers the board 12 by shifting sail position and body weight. Those sailors who are proficient at riding their boards go through extreme maneuvers at times and may, in fact, become airborne as indicated in FIG. 2. To provide a more secure means for imparting foot control to the board 12 during normal sailing and to prevent separation between the sailor 10 and board 12 during aerial maneuvers as in FIG. 2, it is common in the prior art to provide some means of releasably attaching the sailor's feet to the board 12. Two prior art approaches are shown in simplified form in FIGS. 3 and 4. In the approach of FIG. 3, the sailor's foot 16 is inserted into a loop strap 18 extending upward from the top surface 20 of the board 12. In the approach of FIG. 4, the sailor 10 wears a bootie 22 on his foot 16. The bottom of the bootie 22 is covered with one-half 24 of touch fastener material such as that sold under the trademark Velcro. The mating half 26 of the touch fastener material is adhesively attached to the top surface 20 of the board 12. By planting his foot 16 over the mating half 26 of touch fastener material, the bootie 22 and, therefore, the sailor's foot 16 is releasably attached to the top surface 20 of the board 12 by the touch fastener material.

While the touch fastener material approach of FIG. 4 works for some applications, avid sailors performing strenuous maneuvers require the more positive holding power of a strap such as that of FIG. 3. To be useful, on the other hand, the strap 18 of FIG. 3 must be made adjustable so as to accommodate different sized feet and feet with or without booties on (for cold protection). Sailors also adjust straps depending on conditions and type of sailing. If the wind picks up, the sailor may want to tighten the strap on his foot to make it more secure or to make sure he won't be able to slide his foot too far into the strap when working against a strong wind. If the wind lightens, he may wan to loosen his strap while sailing in order to be able to slide his foot in further to gain more control. Often, sailors need to adjust straps on the water, which heretofore has been very difficult, usually requiring the sailor to return to shore. It is also dangerous to have the strap too loose (e.g. not bother to properly adjust it because of the inconvenience) since the sailor's foot may slide too far into the strap. In the event that the sailor subsequently "wipes out", a foot or ankle can be broken if the foot doesn't release because of being too far into the strap. This has happened numerous times with prior art straps.

Various approaches to the basic strap 18 of FIG. 3 appear in the prior art. In one approach as shown in FIG. 5, the ends of the loop strap 18 are slidably attached to a track 28 imbedded in the top surface 20 of the board 12. Cam fasteners 30 can be released to allow the ends of the strap 18 to be positioned where desired as indicated by the arrows 32. When the ends of the strap 18 have been positioned where desired, the cam fasteners 30 are locked in position. As can be appreciated, the approach of FIG. 5 requires that the track 28 be imbedded into the board 12. Additionally, the cam fasteners 30 are not positive locks and, therefore, tend to slip under high forces as occur during violent board maneuvers.

A similar prior art approach is shown in FIG. 6 wherein a cam-locking block 34 is fastened to the top surface 20 of the board 12. One end of the strap 18 is passed through the cam-locking block 34 and adjusted by moving that end in and out as indicated by the arrow 36. As with the previous embodiment, when the desired position is achieved, the cam 38 is used to lock the end of the strap 18 in place. As with the previous embodiment, the loop strap 18 may pull through the cam 38 under high load and particularly in a wet situation. Additionally, the prior art devices of FIGS. 5 and 6 typically require some sort of tool to engage the camming action. The necessity for a separate tool makes periodic adjustments throughout the day inconvenient at best.

A simple prior art approach to providing adjustability (heretofore the most popular type) is shown in FIG. 7 wherein the loop strap 18' comprises two overlapping segments 40 and 42. The facing surfaces of the segments 40, 42 contain the mating portions 24, 26 of touch fastener material 44 whereby the strap 18 can be adjusted to any desired size within the range of the overlapping touch fastener material 44. Again, while useful in low force situations such as the bootie use of touch fastener material as shown in FIG. 4, under high force situations (particularly when the materials are wet), the touch fastener material 44 may stretch or creep in use. If the strap is extended for a very large foot size, the touch fastener material may let go completely in use.

Another prior art approach employing a loop strap 18'' of overlapping segments 40' and 42' is shown in FIG. 8. In this embodiment, one segment 40 contains holes (not shown) which mate with projections 46. While the holding power of the projections 46 in the holes is more positive than the touch fastener material 44, the adjustability is only by the relative difference in distance between the projections 46 and not infinitely adjustable as would be desirable. Additionally, with a larger foot (or foot wearing a bootie) wherein the segments 40, 42 are extended with only a couple of the projections 46 in mating holes, it is possible for the projections 46 to be sheared under high force conditions. Not only would this result in the sailor losing control of the board at the time, it would also render the strap 18'' (and therefore the board 12) useless until replaced.

A final prior art approach to providing adjustability in a foot strap is shown in FIG. 9 wherein the loop strap 18 is fastened at both ends to the top surface 20 of the board 12 having passed through an adjusting member 48 on one end. The adjusting member 48 contains a roller 50 mounted on a threaded shaft 52. By turning the threaded shaft 52, the position of the roller 50 can be adjusted as indicated by the arrow 54 so as to hold the loop strap 18 against the top surface 20 of the board 12 at different points adjacent the one end. As can be appreciated, such an approach is complex, costly, prone to breakage, prone to binding up in a saltwater environment, heavy, and, as with the embodiments of FIGS. 5 and 6, requires a tool (a screwdriver) to perform adjustments. This type is also potentially dangerous to the feet because of all the projecting unpadded components.

Thus, it can be seen that there is no system in the prior art for providing an adjustable footstrap for use with sailboards and the like which is at the same time, positive, simple, lightweight, and easily adjustable on the water.

Wherefore, it is the object of the present invention to provide a foot strap for sailboards, and the like, which is easy to adjust without tools, is simple in construction, resists stretching and resists coming apart under high force loads as imparted during complex board maneuvers, uses no complex mechanical parts to injure feet, and is as positively fastened when it is fully extended as when it is as short as possible.

Other objects and benefits of the present invention will become obvious from a review of the specification which follows hereinafter taken in conjunction with the drawing figures which accompany it.

Further examples of the prior art with respect to the present invention can be found with reference to patents: U.S. Pat. Nos. 4,604,070 (McKee, et al.); 4,466,373 (Prade, et al.); 4,558,655 (Debarge); 4,365,570 (Jamieson); 4,458,859 (Ganeve); 3,593,356 (Schmalfeldt); 4,645,466 (Ellis); 4,592,734 (Metiver); 4,285,082 (Cox); U.K. application GB No. 2 122 561 A; German DE No. 29 36 901 Al; German DE No. 31 16 179 Al; PCT No. WO 83/00312; European patent No. 0 083 106 Al; European patent No. 0 084 863 Al.

SUMMARY

The foregoing objects have been achieved by the adjustable footstrap of the present invention for attachment to the surface of a riding device comprising, an inner strap member comprising a pair of centrally overlapping straps having means for attaching outer ends thereof to the surface of the riding device and means for adjustably fastening inner ends thereof together; and, an outer padded sheath for covering the inner strap member between the outer ends, the padded sheath comprising a generally rectangular piece of a fabric-covered foam material having means on facing opposite edges extending between facing opposite ends for releasably fastening the facing opposite edges together, the padded sheath further having means for releasably fastening the sheath to the inner strap member.

The preferred means for adjustably fastening the inner ends of the strap member together comprises a flexible, non-stretching strap carried by one of the centrally overlapping straps; and, gripping means carried by the other of the centrally overlapping straps for adjustably gripping the flexible, non-stretching strap in infinite increments. The preferred gripping means comprises a buckle through which the non-stretching strap is threaded through and back upon itself.

The preferred means for releasably fastening the facing opposite edges of the outer padded sheath together comprises one-half of a zipper fastened along one of the facing opposite edges and the mating one-half of a zipper fastened along the other of the facing opposite edges. Additionally, it is preferred that a tab is formed into one of the facing opposite edges adjacent an end thereof in the direction of the zipper's closure; one-half of a strip of touch fastener material is fastened to the tab; and, the mating one-half of a strip of touch fastener material is fastened to the other of the facing opposite edges opposite the tab.

The preferred means for releasably fastening the sheath to the inner strap member comprises one-half of a rectangular strip of touch fastener material fastened to the inner middle of the sheath and the mating one-half of a rectangular strip of touch fastener material fastened to a surface of the inner strap member facing the surface of the riding device.

DESCRIPTION OF THE DRAWINGS

FIG. 5 is a simplified drawing of one prior art approach to providing an adjustable foot strap for sailboards and the like.

FIG. 19 is an enlarged end view of the assembled components of FIG. 16 with the shield in its closed position.

FIG. 20 is an enlarged end view of the assembled components of FIGS. 13 and 17 with the shield in its closed position.

FIG. 21 is a top view of one end of one of the members of FIGS. 10 and 11 showing the preferred addition of a padded cover thereover.

FIG. 22 is a bottom view of FIG. 21.

DESCRIPTION OF THE PREFERRED EMBODIMENT

Figure 1:
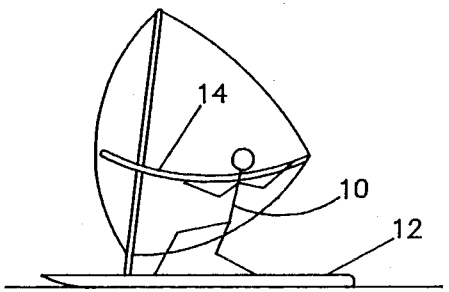
FIG. 1 is a simplified drawing showing a sailor sailing a sailboard.
Figure 2:
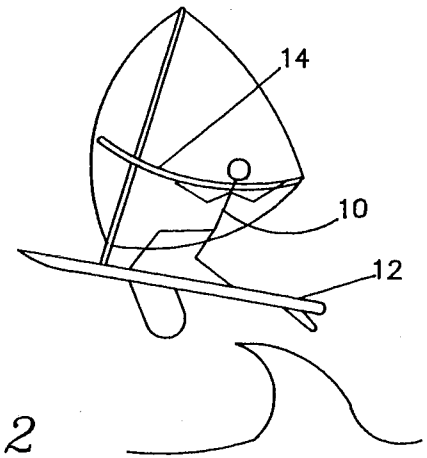
FIG. 2 is a simplified drawing showing the sailor of FIG. 1 during an aerial maneuver.
Figure 3:
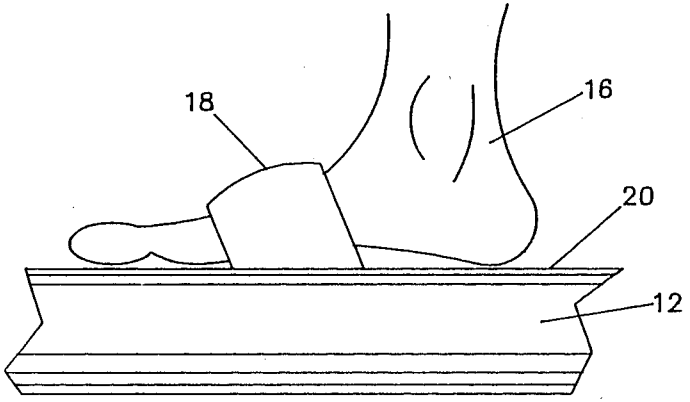
PRIOR ART FIG. 3
FIG. 3 is a simplified side view of a prior art loop strap as employed to secure the sailor's foot to the top of the sailboard.
Figure 4:
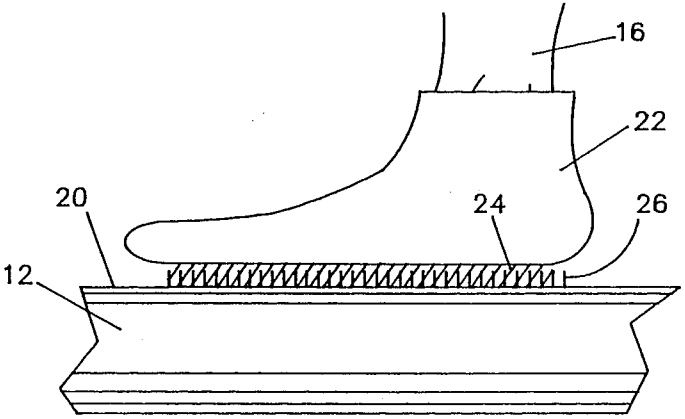
PRIOR ART FIG. 4
FIG. 4 is a side view simplified drawing in the manner of FIG. 3 showing an alternate prior art approach wherein such fastener material applied to the top of the sailboard and the bottom of a bootie worn by a sailor is employed to releasably attach the sailor to the sailboard.
Figure 6:
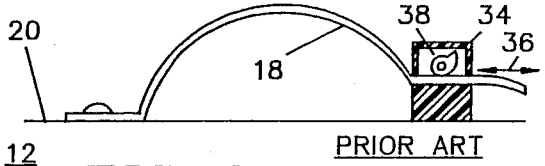
FIG. 6 is a simplified drawing of another prior art approach to the adjustable foot strap.
Figure 5:
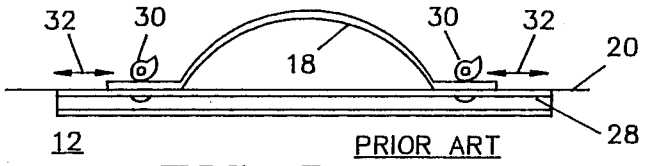
Figure 8:
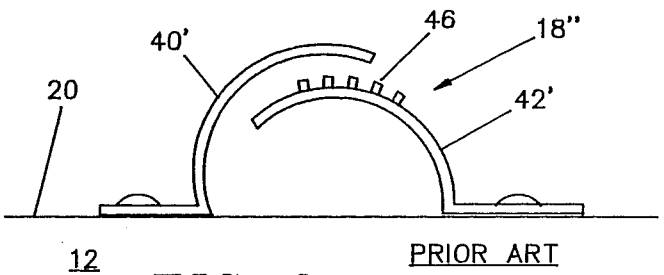
FIG. 8 is yet another prior art approach to providing adjustable foot straps.
Figure 7:
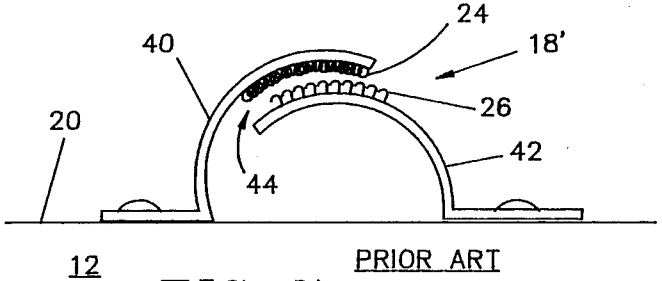
FIG. 7 is yet another prior art approach to providing adjustable foot straps.
Figure 9:
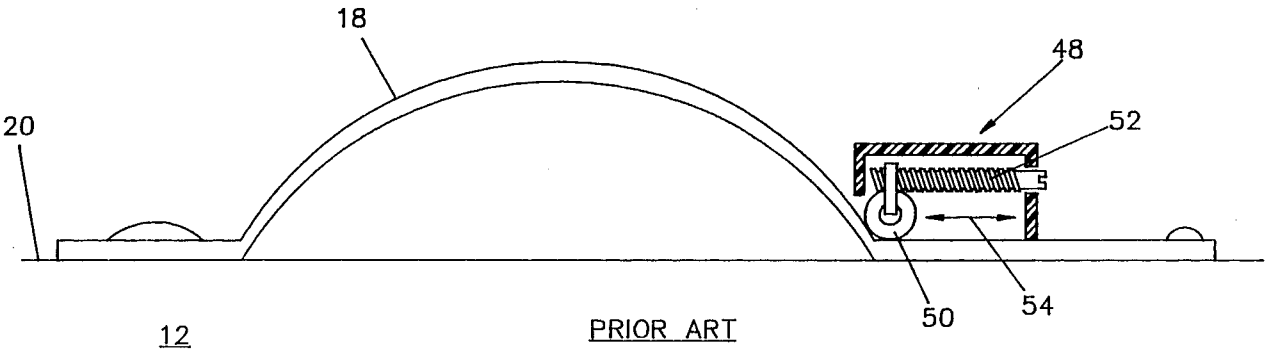
FIG. 9 is a final prior art approach to providing adjustable foot straps.
Figures 10, 11, 12, 13:
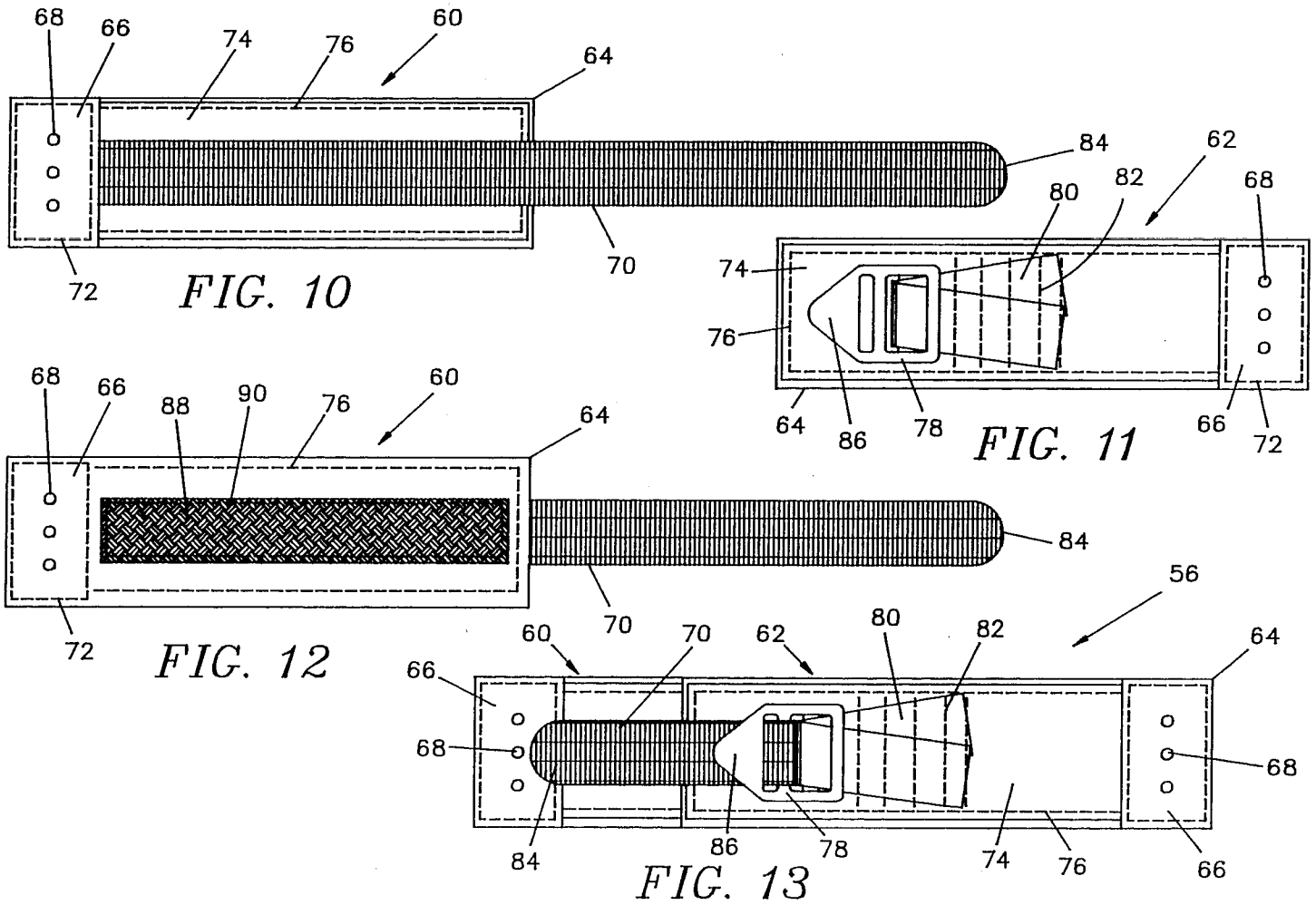
FIG. 10 is a top view of one of the overlapping members of the foot strap of the present invention.
FIG. 11 is a top view of the other of the overlapping members of the foot strap of the present invention.
FIG. 12 is a bottom view of the member of FIG. 10.
FIG. 13 shows the two overlapping portions of FIGS. 10 and 11 in their assembled state.

The adjustable strap of the present invention and its components in a preferred embodiment thereof are shown in FIGS. 10–16 and 19. There is an inner strap member, generally indicated as 56, contained within an outer padded sheath 58. As best seen in FIGS. 10–12, the inner strap member 56 comprises a strap piece 60 and a buckle piece 62 as shown in FIGS. 10 and 11, respectively. The strap piece 60 comprises a strip 64 of a heavy duty nylon webbing material such as employed in automobile seatbelts. The end is folded over to form a reinforced mounting area at 66 having one or more holes 68 therethrough through which a screw, or the like, can be passed to fasten the strip 64 to the top surface of a sailboard, or the like. One or more fastening straps 70 are attached to the strip 64 at one end by disposing it between the folded over mounting area 66 and securing it with stitching 72. The fastening strap 70 is of a nylon woven material, or the like, having a dense enough weave to resist stretching while, at the same time, being flexible enough to adjust easily and hold securely in a buckle. A thin strip of stiffener material 74 is sewed to the webbing strip 64 about the periphery as indicated at 76. The stiffener material 74 is of a thin plastic such as polycarbonate which is longitudinally stiff but laterally resiliently flexible and able to be stitched without being predrilled.

The buckle piece 62, as shown in FIG. 11, also comprises a strip 64 of the seat belting material having a mounting area 66 formed at one end by folding over and stitching at 72 and with holes 68 therethrough for mounting purposes. It is also provided with a stiffening material 74 peripherally stitched at 76. One or more buckles 78 (the same number as straps 70) are attached to the opposite end by means of a piece (or pieces) of nylon webbing material 80 stitched at 82. As shown in the assembled drawing of FIG. 13, the strips 64 are overlapped and the fastening strap 70 passed through the buckle 78 and folded back upon itself. The buckle 78 is of a type well known in the art wherein the inner strap member 56 can be shortened or tightened by pulling on the end 84 of the fastening strap 70 or loosened by lifting the tab 86 of the buckle 78. As those skilled in the art will appreciate, other fastening devices for adjustably gripping the strap 70 could be substituted for the buckle 78 within the scope and spirit of the present invention. A rectangular strip 88 of the loop portion of touch fastener material such as that sold under the trademark Velcro is longitudinally attached to the bottom of the webbing strip 64 with peripheral stitching 90 as shown in the bottom view of FIG. 12. The reason for this will be seen shortly.

Figure 15:
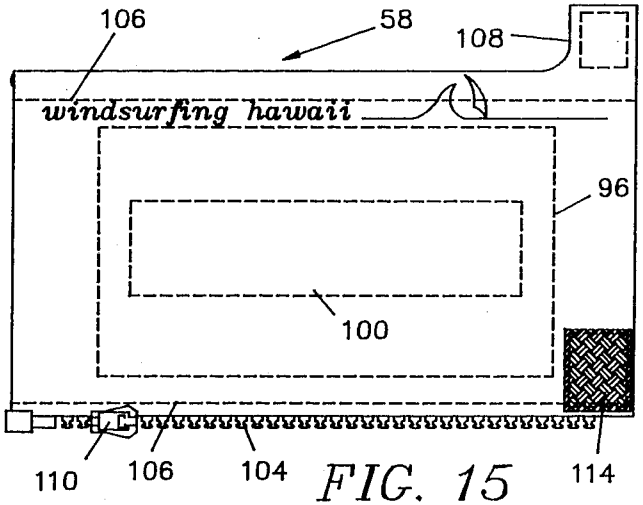
FIG. 15 is a bottom view of the padded shield member of FIG. 14.
Figure 14:
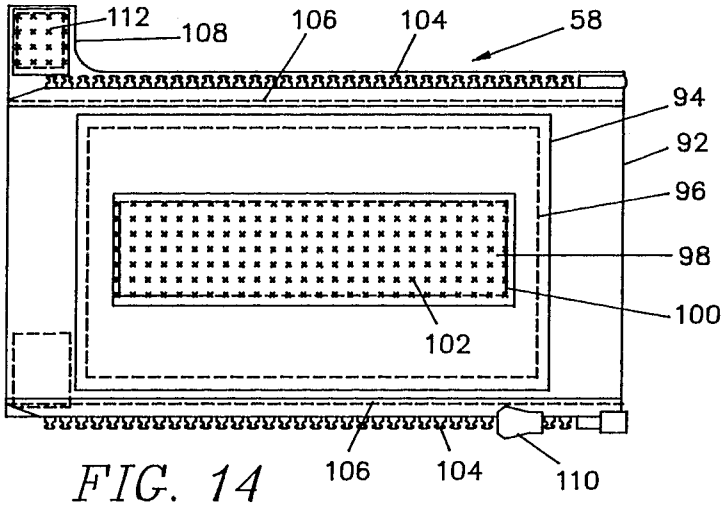
FIG. 14 is a top view of the padded shield member employed as part of the foot strap of the present invention in its preferred embodiment.
Figure 16:
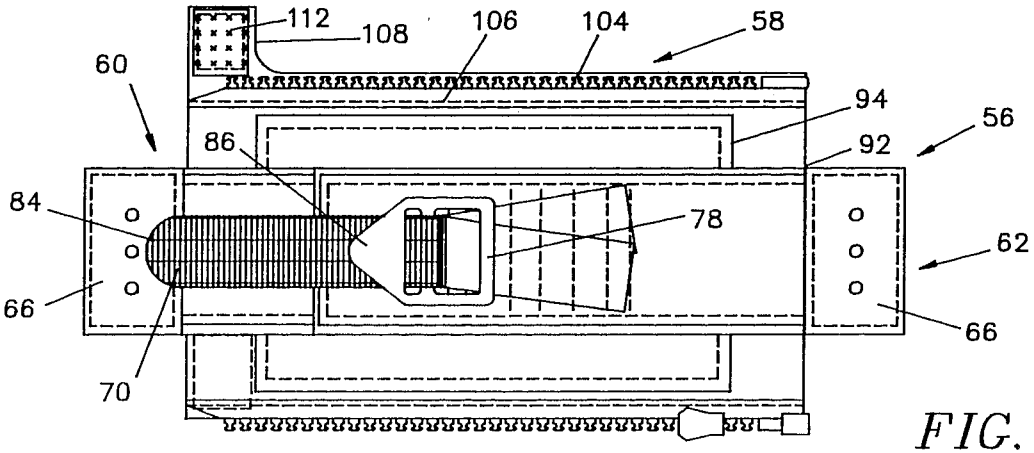
FIG. 16 shows the assembled strap portions of FIG. 13 mounted to the shield portion of FIG. 14.

The preferred outer padded sheath 58 is shown in a top (or inner) view in FIG. 14 and a bottom (or outer) view in FIG. 15. The locking sheath 58 is formed of a rectangular piece 92 of fabric covered neoprene foam material as employed in the manufacture of wetsuits, and the like. A square 94 of the same material is peripherally stitched at 96 to hold the square centrally located within the piece 92 to act as additional padding. A rectangular strip 98 of the hook portion of touch fastener material is peripherally stitched at 100 along the center of the piece 92 and padding square 94 with the hooks 102 facing inward. The strip 86 is substantially the same length as the connected strips 64 between the mounting areas 66 as shown in FIG. 16. The two halves of a large-toothed plastic zipper 104 are stitched at 106 along the side edges of the fabric piece 92 as best seen in FIG. 14. A tab 108 is formed in the fabric piece 92 at one side adjacent the end where the zipper slider 110 is when the two portions of the zipper 104 are zipped together. The inner surface of the tab 108 has the hook portion 112 of touch fastener material stitched thereto and the outer surface of the facing edge of the fabric piece 92 has the mating loop portion 114 stitched thereto. With the assembled inner strap member 56 disposed in the outer padded sheath 58 and those components held together by the touch fastener portions 88, 98 and the zipper 104 zipped together, the tab 108 folds over the opposite edge of the fabric piece 92 to be releasably held together by the touch fastener portions 112, 114, as shown in end view in FIG. 19. The tab 108, of course, locks the edges of the fabric piece 92 together to prevent accidental sliding of the zipper 104 to an opened (or partially opened) position. As mentioned above, the assembled inner strap member 56 and the outer padded sheath 58 are held together by the touch fastener portions 88, 98 so that the outer padded sheath 58 cannot be accidentally lost when it is opened (even on the water) to adjust the straps 70.

Figure 17:
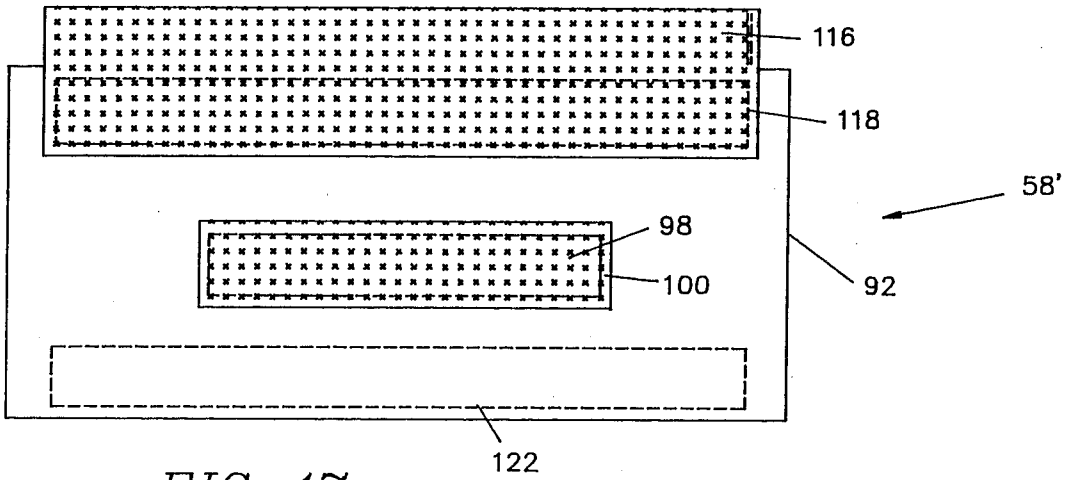
FIG. 17 is a top view of a padded shield member employed as part of the foot strap of the present invention in an alternate embodiment.
Figure 18:
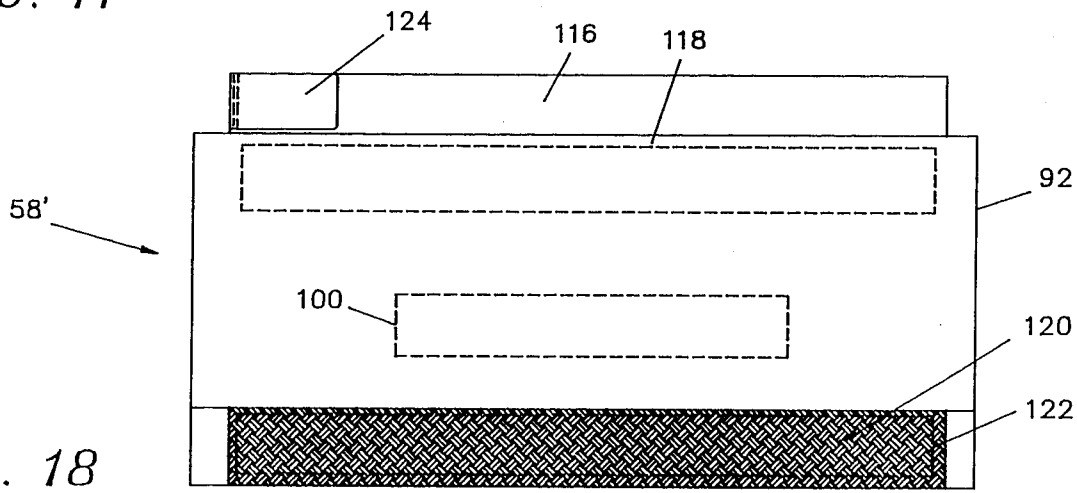
FIG. 18 is a bottom view of the padded shield member of FIG. 17.

An alternate and non-preferred embodiment of the outer padded sheath, generally indicated as 58′, is shown individually in FIGS. 17 and 18 and assembled with the inner strap member 56 in FIG. 20. As with the sheath 58 of the preferred embodiment, there is a padded fabric piece 92 having the touch fastener strip 98 stitched in the center thereof. The padding square 94 can be added if desired (but is not shown for simplicity). In lieu of the zipper 104, strips of touch fastener material are employed. There is one rectangular strip 116 of the hook portion of touch fastener material attached along one edge by stitching at 118. A rectangular strip 120 of the loop portion of touch fastener material is attached to the opposite edge of the rectangular fabric piece 92 from the strip 116 and facing outward by stitching at 122. As shown in FIG. 18, a releasing tab 124 is sewn to one end of the exposed portion of the strip 92 on the outer surface thereof.

The manner of use of this embodiment can best be understood with reference to FIG. 20. With the outer padded sheath 58′ in its opened position of FIG. 17, the fastening strap 70 is adjusted in the buckle 78 to the proper length as with the previous embodiment. The edge of the rectangular fabric piece 92 containing the strip 120 of loop material is folded over the inner strap member 56 and then the opposite edge of the fabric piece 92 containing the strip 116 of hook material is folded over the inner strap member 56 and strip 120 of loop material in combination. As shown in FIG. 20, in this embodiment, the hooks of the strip 116 engage both the strip 120 of loop material and the fastening strap 70 along the length thereof. This both holds the sheath 58′ in a closed condition and locks the fastening strap 70 against any further movement. To open the locking sheath 58′ to adjust the inner strap member 56, the releasing tab 124 is raised as indicated in FIG. 20 whereby the releasing tab 124 is easily gripped and pulled to pull the strip 116 of hook material out of engagement with the strip 120 of loop material and the fastening strap 70.

One added safety feature of the present invention as incorporated in the preferred commercial embodiment of the assignee hereof is shown in FIGS. 21 and 22. As shown therein, a padded protective cap 126 is sewn to the ends of the webbing strips 64 about the periphery of the mounting areas 66. The caps 126 are of the same fabric-covered padded material as the sheath 58 and cover the screws (not shown) which are passed through the holes 68 for attaching the inner strap member 56 to the surface of a sailboard, or the like. The material is stretchable, so that the cap edge at 128 can be stretched back to expose the holes 68 for mounting. Thereafter, the caps 126 protect the sailor's feet from catching on the mounting screws or the edges of the webbing 64 adjacent the mounting areas 66.

I claim:

1. An adjustable footstrap for attachment to the surface of a riding device comprising:

(a) an inner strap member comprising a pair of centrally overlapping straps having means for attaching outer ends thereof to the surface of the riding device and means for adjustably fastening inner ends thereof together;

(b) one-half of a rectangular strip of touch fastener material fastened to a surface of said inner strap member facing the top surface of the riding device;

(c) an outer padded sheath for covering said inner strap member between said outer ends, said padded sheath comprising a generally rectangular piece of a fabric-covered foam material having means on facing opposite edges extending between facing opposite ends for releasably fastening said facing oposite edges together; and, (d) a mating one-half of said rectangular strip of touch fastener material fastened to an inner middle portion of said sheath facing away from said surface of the riding device whereby said padded sheath can be releasably fastened to said inner strap member.

2. The footstrap of claim 1 wherein said means for adjustably fastening said inner ends of said strap member together comprise:

(a) a separate, flexible, non-stretching strap carried by one of said centrally overlapping straps; and, (b) gripping means carried by the other of said centrally overlapping straps for adjustably gripping said flexible, non-stretching strap in infinite increments.

3. The footstrap of claim 2 wherein:

said gripping means comprises a buckle through which said separate, flexible, non-stretching strap is threaded through and back upon itself.

4. The footstrap of claim 1 wherein said means for releasably fastening said facing opposite edges of said outer padded sheath together comprises:

(a) one-half of a rectangular strip of touch fastener material fastened along one of said facing opposite edges;

(b) a mating one-half of said rectangular strip of touch fastener material fastened along the other of said facing opposite edges;

(c) said means for adjustably fastening said inner ends of said strap member together including a separate, flexible, non-stretching strap of a woven material carried by one of said centrally overlapping straps; and, (b) one of said one-halfs of said rectangular strip of touch fastener material is a hook-carrying portion disposed along a wide enough strip to engage said strap of woven material in addition to a loop-carrying portion of touch fastener material which comprises the other one of said one-halfs of said rectangular strip of touch fastener material.

5. The footstrap of claim 1 wherein:

(a) said means for attaching said outer ends of said inner strap member to the surface of the riding device comprises a reinforced mounting area formed into each of said outer ends and having a hole therethrough through which a screw can be passed to fasten said reinforced mounting area to the surface of the riding device; and additionally comprising, (b) a separate padded protective cap carried by each of said outer ends covering said reinforced mounting area thereof and said hole.

6. An adjustable footstrap for attachment to the surface of a sailboard or the like comprising:

(a) an inner strap member comprising a pair of centrally overlapping straps having means for attaching outer ends thereof to the surface of the sailboard;

(b) an outer padded sheath for covering said inner strap member only between said outer ends, said padded sheath comprising a generally rectangular piece of a fabric-covered foam material having means on facing opposite edges extending between facing opposite ends for releasably fastening said facing opposite edges together;

(c) a separate, flexible, non-stretching strap carried by one of said centrally overlapping straps;

(d) gripping means carried by the other of said centrally overlapping straps for adjustably gripping said separate, flexible, non-stretching strap in infinite increments; wherein, (e) said means for attaching said outer ends of said inner strap member to the surface of the sailboard comprises a reinforced mounting area formed into each of said outer ends and having a hole therethrough through which a screw can be passec to fasten said reinforced mounting area to the surface of the sailboard; and additionally comprising, (f) a separate padded protective cap carried by each of said outer ends covering said reinforced mounting area thereof and said hole.

* * * * *